US009793604B2

(12) United States Patent
Kim et al.

(10) Patent No.: US 9,793,604 B2
(45) Date of Patent: Oct. 17, 2017

(54) ANTENNA USING LIQUID METAL AND ELECTRONIC DEVICE EMPLOYING THE SAME

(71) Applicant: Samsung Electronics Co., Ltd., Gyeonggi-do (KR)

(72) Inventors: Hosaeng Kim, Gyeonggi-do (KR); Yoonjae Lee, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 193 days.

(21) Appl. No.: 14/028,732

(22) Filed: Sep. 17, 2013

(65) Prior Publication Data

US 2014/0078019 A1 Mar. 20, 2014

(30) Foreign Application Priority Data

Sep. 17, 2012 (KR) ..... 10-2012-0102569

(51) Int. Cl.

| | |
|---|---|
| ***H01Q 3/01*** | (2006.01) |
| ***H01Q 1/36*** | (2006.01) |
| ***H01Q 3/24*** | (2006.01) |
| *H01Q 1/24* | (2006.01) |

(52) U.S. Cl.

CPC ..... *H01Q 3/01* (2013.01); *H01Q 1/364* (2013.01); *H01Q 3/247* (2013.01); *H01Q 1/245* (2013.01)

(58) Field of Classification Search

CPC ..... H01Q 1/364; H01Q 3/01; H01Q 1/245; H01Q 3/247

See application file for complete search history.

(56) References Cited

U.S. PATENT DOCUMENTS

| | | | | |
|---|---|---|---|---|
| 6,891,501 | B2 * | 5/2005 | Rawnick et al. | 343/700 MS |
| 7,593,538 | B2 | 9/2009 | Polinske | |
| 2004/0252069 | A1 * | 12/2004 | Rawnick et al. | H01Q 1/364 343/789 |
| 2005/0017915 | A1 * | 1/2005 | Brown et al. | 343/786 |
| 2010/0109970 | A1 | 5/2010 | Ganwani et al. | |
| 2010/0231473 | A1 | 9/2010 | Shtrom et al. | |

(Continued)

FOREIGN PATENT DOCUMENTS

| | | | |
|---|---|---|---|
| CN | 101834643 | A | 9/2010 |
| EP | 2 228 868 | A1 | 9/2010 |
| KR | 10-2007-0090487 | A | 9/2007 |

OTHER PUBLICATIONS

Chinese Search Report dated Mar. 23, 2017.

*Primary Examiner* — Jessica Han
*Assistant Examiner* — Noel Maldonado
(74) *Attorney, Agent, or Firm* — Cha & Reiter, LLC.

(57) ABSTRACT

An antenna using a liquid metal is provided. The antenna includes a plurality of antenna structures, each having an inner cavity of a form corresponding to a radiator pattern; and at least one actuator connected to at least two of the plurality of antenna structures to control movement of the liquid metal to supply the liquid metal to at least one of the antenna structures. Thereby, deterioration of an antenna performance due to an influence of a human body can be prevented, and deterioration of an antenna performance can be prevented due to a form change of an electronic device including the antenna. In this manner, optimal antenna radiation performance can be dynamically realized.

9 Claims, 13 Drawing Sheets

(56) References Cited

U.S. PATENT DOCUMENTS

| | | | | |
|---|---|---|---|---|
| 2011/0241948 | A1 | 10/2011 | Bevelacqua et al. | |
| 2011/0298684 | A1 | 12/2011 | Quan et al. | |
| 2012/0007778 | A1* | 1/2012 | Duwel et al. | H01Q 3/446 342/368 |
| 2012/0075069 | A1* | 3/2012 | Dickey et al. | 340/10.1 |

* cited by examiner

1000

ANTENNA USING LIQUID METAL AND ELECTRONIC DEVICE EMPLOYING THE SAME

CLAIM OF PRIORITY

This application claims the benefit under 35 U.S.C. §119 (a) of a Korean patent application filed on Sep. 17, 2012 in the Korean Intellectual Property Office and assigned Serial No. 10-2012-0102569, the entire disclosure of which is hereby incorporated by reference.

BACKGROUND

Technical Field

The present disclosure relates to antennas, and more particularly, to an antenna using a liquid metal employed in an electronic device.

Description of the Related Art

Due to recent advances in computing and telecommunications, portable electronic devices (commonly called mobile or portable terminals) such as smartphones are widely used. A portable device may provide various communication functions such as a mobile communication function, global positioning system (GPS) receiving function, Bluetooth communication function, Wi-Fi communication function, WiBro communication function, and digital broadcasting (e.g., mobile broadcasting such as digital multimedia broadcasting (DMB) or digital video broadcasting (DVB)) receiving function. One or more antennas are included within the device to transmit/receive signals for the various wireless communication functions.

A conventional antenna is formed to have a specific conductor pattern using a metal conductor. The conventional antenna is fixed and installed at a specific position of the mobile terminal, so that a form and position of the antenna cannot be changed. Thereby, a problem of antenna performance degradation may occur, particularly in portable devices, in certain use environments. For example, when a user's hand or other body part is proximate the antenna location of the portable device, antenna performance may deteriorate. Further, it is difficult to apply a conventional antenna to a flexible mobile terminal. This is because a fixed form metal antenna used in a flexible mobile terminal may develop a crack. Moreover, in states in which a flexible mobile terminal is folded and unfolded, antenna performance can change below requirements.

Accordingly, there is a need for an antenna that can maintain requisite performance despite influence of a human body, and which is suitable for use in a flexible mobile terminal.

SUMMARY

The present technology provides an antenna using a liquid metal that can maintain a requisite radiation performance under an influence of a human body, and an electronic device employing the same.

The present technology further provides an antenna using a liquid metal implemented in a flexible portable device, which maintains a requisite radiation performance despite a form change of the flexible device.

In accordance with an aspect of the present technology, an antenna using liquid metal includes: a plurality of antenna structures, each having an inner cavity of a form corresponding to a radiator pattern; and at least one actuator connected to at least two of the plurality of antenna structures to control movement of the liquid metal to supply the liquid metal to at least one of the antenna structures.

In accordance with another aspect, an antenna using a liquid metal includes an antenna structure comprising the liquid metal at inner space; and at least one actuator positioned in mechanical relation to the antenna structure to enable the liquid metal to have a specific radiator pattern by pressing a partial area of the antenna structure according to a control signal.

In another aspect, an antenna using a liquid metal includes a radiator pattern portion comprising the liquid metal and a plurality of metal pattern elements at an inner space; and a pattern controller attached to one surface of the radiator pattern portion and comprising a plurality of electromagnets. The plurality of metal pattern elements are separated, and the plurality of electromagnets are controlled to control electrical connection of the metal pattern elements to generate an overall radiator pattern.

In one or more embodiments, an antenna using a liquid metal and an electronic device using the same as described herein can prevent deterioration of antenna performance due to an influence of a human body. Further, the antenna can maintain suitable performance when a form of the flexible device changes. Thereby, the present technology can dynamically realize an optimal antenna radiation performance, thus improving communication quality.

DETAILED DESCRIPTION

Hereinafter, exemplary embodiments of the present technology are described in detail with reference to the accompanying drawings. The same reference numbers are used throughout the drawings to refer to the same or like parts. For the purposes of clarity and simplicity, detailed descriptions of well-known functions and structures incorporated herein may be omitted to avoid obscuring the subject matter of the present technology.

While the present technology may be embodied in many different forms, specific embodiments are shown in drawings and are described herein in detail, with the understanding that the present disclosure is to be considered as an exemplification of the principles of the technology and is not intended to limit the technology to the specific embodiments illustrated.

The following exemplary embodiments of antennas can each be included within an electronic device capable of receiving and/or transmitting an information or communication signal. The electronic device may be a portable, hand held device such as a smartphone, a tablet PC, a notebook computer, and the like. The electronic device may also be flexible. The term "mobile terminal" may be used interchangeably with "electronic device".

Figure 1:
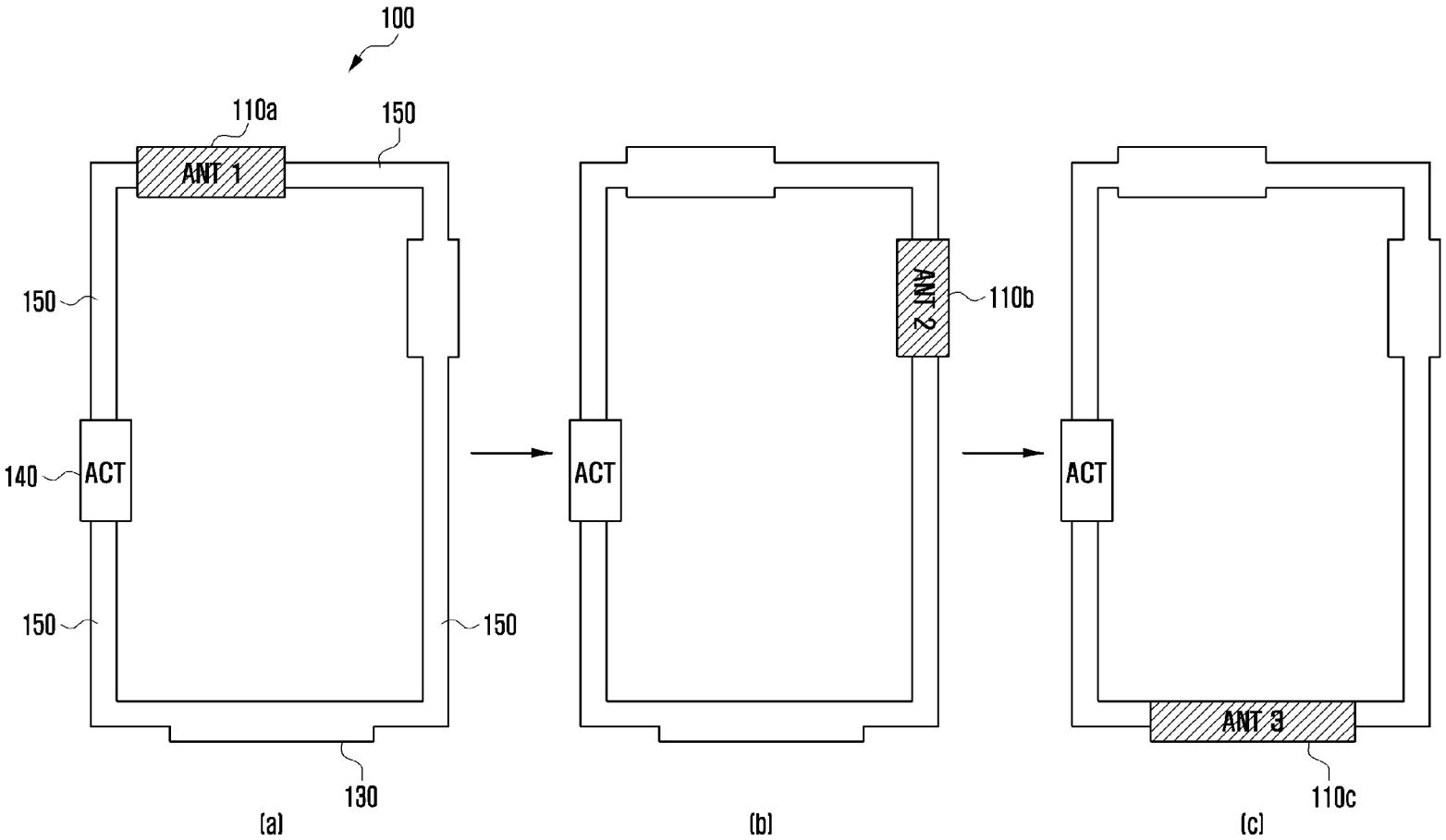
FIG. 1 is a diagram illustrating an antenna using a liquid metal according to a first exemplary embodiment.

FIG. 1 is a diagram illustrating an antenna, 100, using liquid metal to dynamically configure a radiator according to a first exemplary embodiment of the present technology. Antenna 100 includes a first antenna structure 110*a*, second antenna structure 110*b*, third antenna structure 110*c*, actuator 140, and tube 150. Although three antenna structures are exemplified, only two, or more than three, can be employed in alternative designs.

The tube 150 functions as a conduit by which liquid metal moves between antenna structures, i.e, it performs a moving path function of a liquid metal. Tube 150 has portions positioned between the actuator 140 and each of antenna structures 110*a* and 110*c*. Tube 150 has another portion between antenna structures 110*a* and 110*b*, and between antenna structures 110*b* and 110*c*. When the antenna 100 is applied to a flexible electronic device, the tube 150 is made of a flexible material.

When antenna 100 is first constructed, a small amount of liquid metal is suitably injected within the closed cavity comprising tube 150, actuator 140 and antenna structures 110*a*, 110*b* and 110*c*. The actuator 140 circulates this liquid metal along the tube 150 to supply the liquid metal to one or more of antenna structures 110*a*, 110*b* or 110*c* at any given time, depending on the environmental conditions. In the diagram of FIG. 1, actuator 140 may circulate a liquid metal clockwise or counterclockwise. For example, in a state (a) in which the liquid metal is supplied to the first antenna structure 110*a*, when a human body (e.g., a user's hand) is sensed by a sensor to be proximate the first antenna structure 110*a*, the actuator 140 may move the liquid metal of the first antenna structure 110*a* to the second antenna structure 110*b* as shown in diagram (b), or to the third antenna structure 110*c* as shown in diagram (c), by the control of a controller (not shown). The actuator 140 may be formed with a micro-pump. In this manner, the second or third antenna structure 110*b* or 110*c* will replace the first antenna structure 110*a* as the current operating antenna for the electronic device.

Hereafter, general reference to an antenna structure 110*i* will refer to any one of the first, second or third antenna structures 110*a*, 110*b* or 110*c*. Antenna structure 110*i* has an inner cavity (space) corresponding to an antenna conductor pattern (interchangeably, "radiator pattern"). That is, when a liquid metal is filled at the inner cavity of antenna structure 110*i*, it operates as an antenna for transmitting and receiving a wireless signal. Antenna structure 110*i* may have a form of a monopole antenna, (planar) inverted F antenna (P) IFA antenna), or loop antenna. To this end, forms of the first to third antenna structures 110*a*-110*c* may each be the same, or they may differ, in accordance with the particular application requirements and space constraints.

Figure 2:
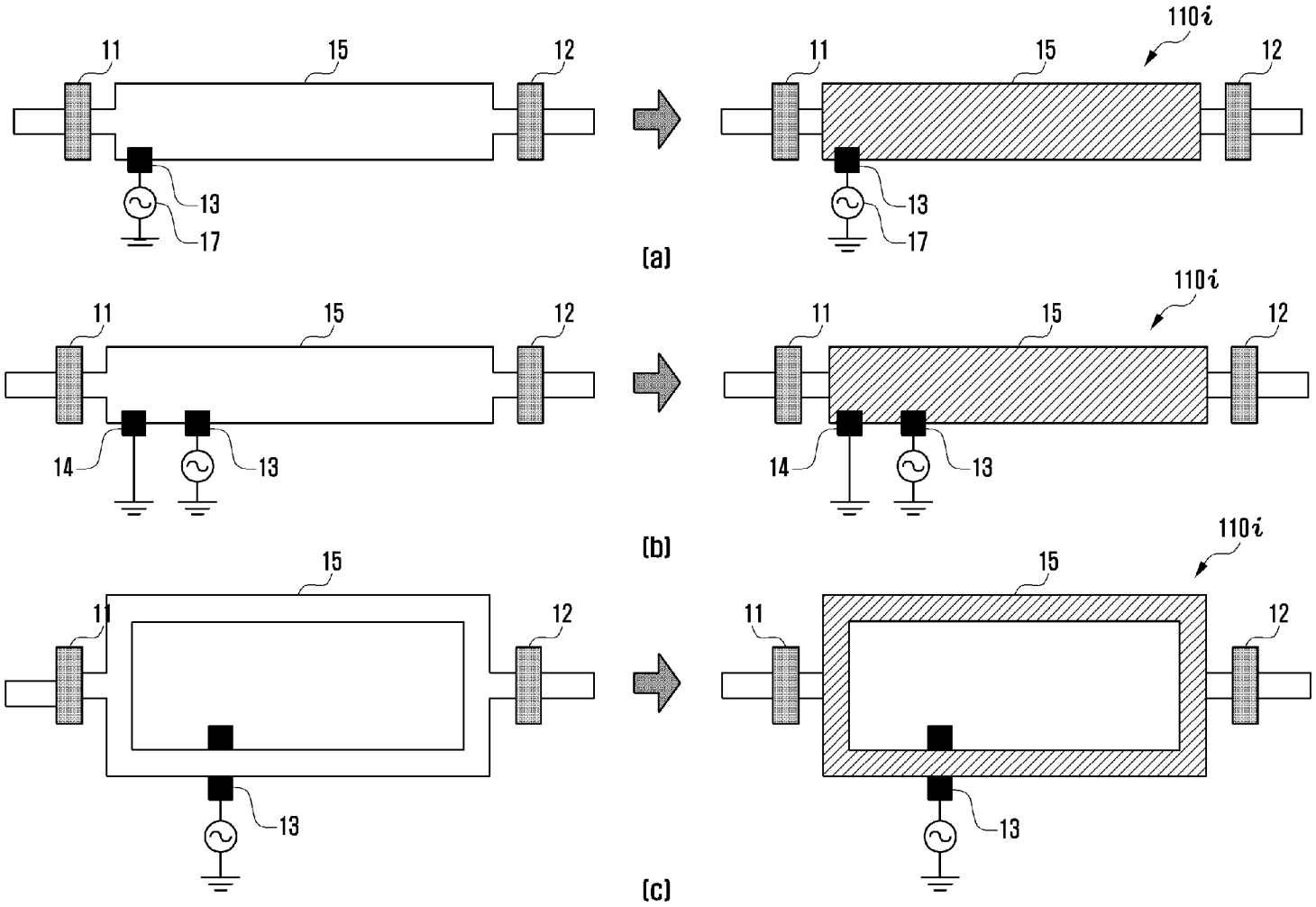
FIG. 2 is a diagram illustrating an antenna structure according to a first exemplary embodiment.

FIG. 2 illustrates exemplary configurations for any of the first to third antenna structures 110*a*, 110*b* or 110*c*. The left side of each diagram in FIG. 2 illustrates a state before a liquid metal is supplied, and the right side illustrates a state after a liquid metal is supplied.

Each exemplary antenna structure 110*i* includes a first valve 11, second valve 12, RF power feed connector 13, and body 15. In diagram (a) depicting a first configuration, when a liquid metal fills the body 15, antenna structure 110*i* operates as a monopole antenna. RF feed connector 13 can be a hermetically sealed pin that penetrates into the cavity of body 15, and makes suitable electrical contact with the liquid metal therein. RF feed connector 13 connects to an RF source 17 when transmitting, and/or to a receiver (not shown) when receiving.

Alternatively, as shown in diagram (b), antenna structure 110*i* further includes a ground connector 14, and when a liquid metal is filled in the body 15, the antenna structure 110*i* operates as a (P) IFA antenna. Ground connector 14 can be of similar construction to RF feed connector 13, except that it connects to a ground point rather than to an RF source.

In diagram (c), an alternative antenna structure 110*i* is shown which includes the first valve 11, second valve 12, RF feed connector 13, and body 15 having a loop form. Here, when a liquid metal fills the body 15, antenna structure 110*i* operates as a loop antenna.

In each of the above cases, the first valve 11 and the second valve 12 are opened or closed according to a control signal to control injection and discharge of the liquid metal. The RF feed connector 13 can be formed to directly contact the liquid metal, as shown in diagrams (a) and (b). Alternatively, RF feed connector 13 may be formed to indirectly contact with a liquid metal through electrical coupling, as shown in diagram (c). In this case, the RF feed connector 13 can have a structure of a loop surrounding a small portion of the body 15.

As mentioned above, a controller controls the actuator 140 according to a state of the electronic device to supply a liquid metal to one or more of the first to third antenna structures 110*a*-110*c*. A detailed description thereof is described below with reference to FIG. 3.

In accordance with the foregoing description, a liquid metal can be supplied to one of the first to third antenna structures 110*a* to 110*c*. In other embodiments, liquid metal may be supplied to two of the antenna structures concurrently, according to a particular application. This is because as the electronic device provides various functions, the electronic device may require a plurality of antennas.

Further, it has been described that the antenna 100 can include three antenna structures and one actuator. In other implementations, an antenna according to the present technology may include only two, or more than three more antenna structures and/or at least additional actuator.

Figure 3:
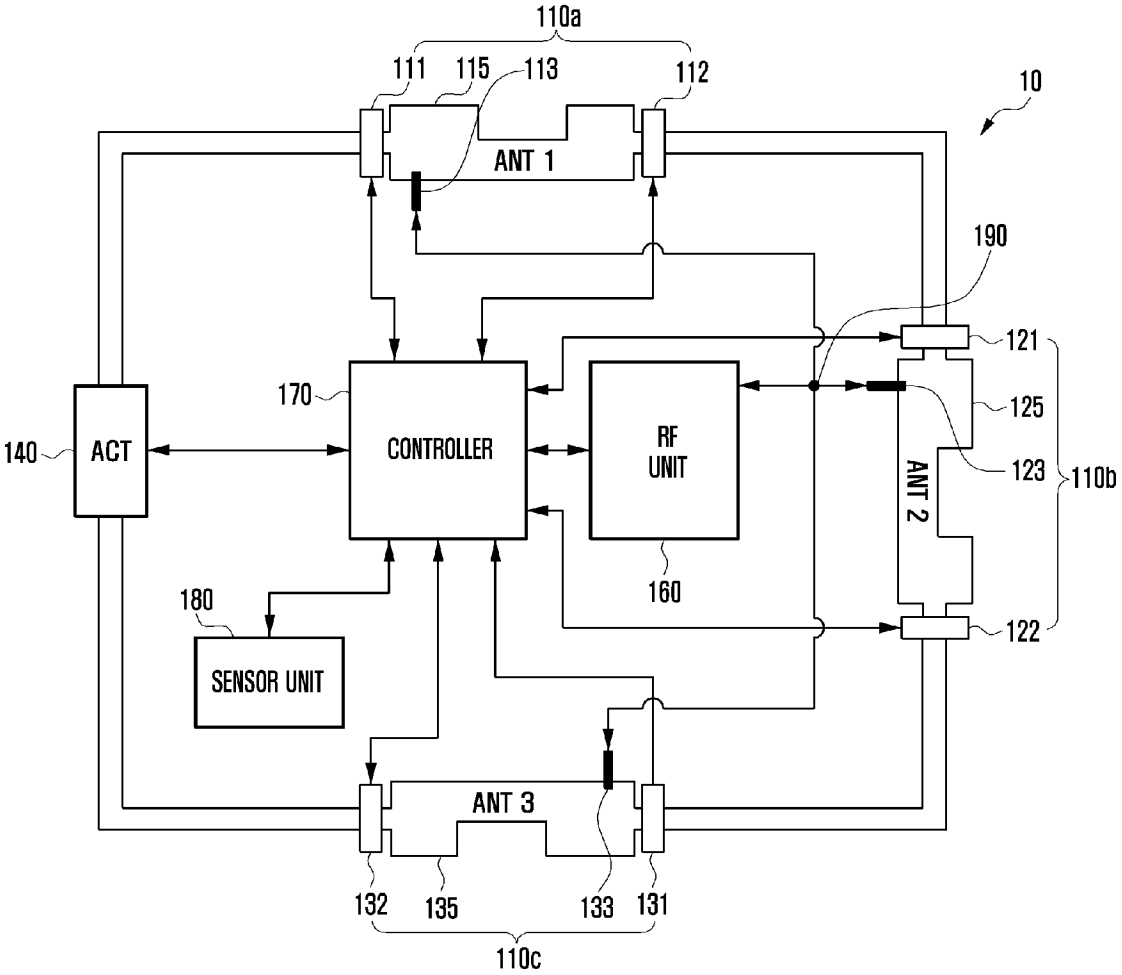
FIG. 3 is a diagram illustrating an electronic device including an antenna using a liquid metal according to a first exemplary embodiment.

FIG. 3 is a block diagram illustrating components of an electronic device 10, including the antenna 100 using liquid metal. FIG. 4 is a diagram illustrating an operation example of an antenna 100 of an electronic device according to an exemplary embodiment.

Referring to FIGS. 3 and 4, electronic device 10 includes antenna 100, wireless communication (RF) unit 160, controller 170, and sensor unit 180. Antenna 100 has been described with reference to FIGS. 1 and 2 and thus a detailed description thereof is omitted.

The RF unit 160 supports a communication function of the electronic device 10, and when the electronic device 10 supports a telephony function, the RF unit 160 may be formed as a telephony type mobile communication module. The RF unit 160 includes an RF transmitter for up-converting a frequency of a signal to be transmitted and amplifying the signal, and an RF receiver for down-converting a frequency of a received signal and low-noise amplifying the signal. Particularly, the RF unit 160 according to the present exemplary embodiment transmits and receives a wireless signal through an antenna structure in which a liquid metal is supplied in the first antenna structure 110*a* to the third antenna structure 110*c*.

Figure 4A:
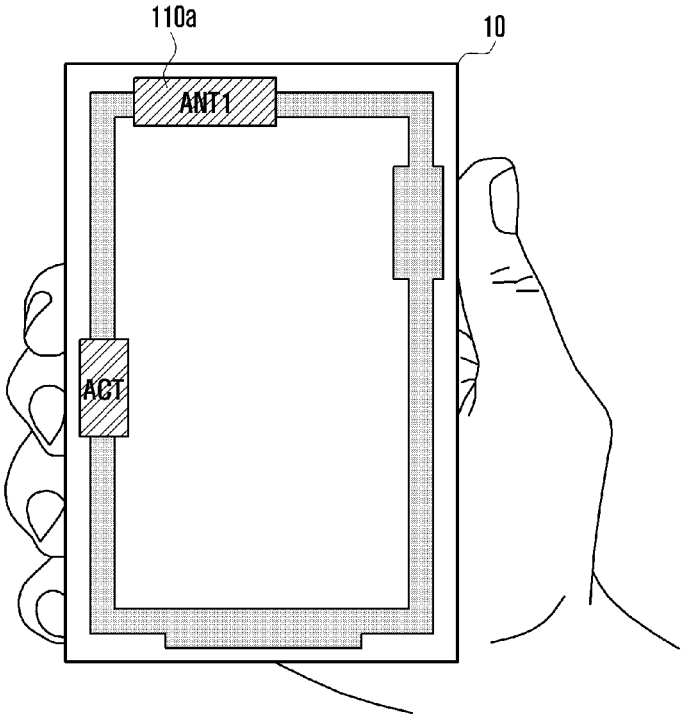
FIGS. 4A and 4B are diagrams illustrating operation examples of an antenna of an electronic device according to a first exemplary embodiment.
Figure 4B:
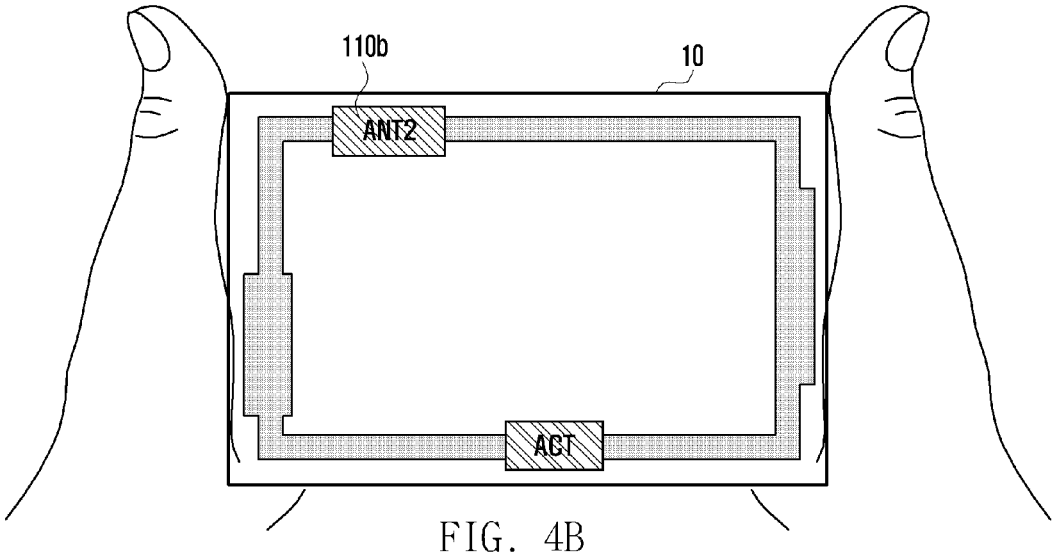

The sensor unit 180 senses a state of the electronic device 10 and includes various sensors such as an acceleration sensor, gravity sensor, gyroscope sensor, terrestrial magnetic sensor, motion sensor and proximity sensor. The sensor unit 180 transmits a sensed value to the controller 170 according to a state of the electronic device 10. For example, in a state in which the electronic device 10 is a portrait view mode, the sensor unit 180 transmits sensed values indicative of the orientation to the controller 170, as shown in FIG. 4A, and in a state in which the electronic device 10 is a landscape view mode, the sensor unit 180 transmits corresponding sensed values to the controller 170, as shown in FIG. 4B.

The sensor unit 180 also senses a form change of the electronic device 10. For example, the sensor unit 180 may recognize a folded state and a spread (unfolded, open) state of a foldable flexible mobile terminal. For example, a magnet and a terrestrial magnetic sensor are each installed at opposite folders of electronic device 10, and by sensing a magnetic change of the terrestrial magnetic sensor, a folded state and a spread state of the flexible electronic device 10 are recognized.

The controller 170 controls the actuator 140 and a plurality of valves 111, 112, 121, 122, 131, and 132 to supply a liquid metal to one of the first to third antenna structures 110*a* to 110*c* according to a mode (or a form) of the electronic device 10 sensed through the sensor unit 180. For example, as shown in FIG. 4A, when electronic device 10 is in a portrait view mode, it is desired for antenna structure 110*a* to act as the sole antenna among the antenna structures 110*a* to 110*c*. In the example, antenna structure 110*a* is located at the top of the electronic device 10 in the portrait mode orientation, and is thus the antenna structure least affected by the presence of the user's hand in this orientation. In this condition, controller 170 controls the actuator 140 to supply a liquid metal to a body 115 of the first antenna structure 110*a* and not to the other antenna structures. Specifically, after the controller 170 controls the second valve 112 to close and the first valve 111 and the third valve 121 to the sixth valve 132 to open, the controller 170 controls the actuator 140 to circulate a liquid metal clockwise. The liquid metal is supplied to the body 115 of the first antenna structure 110 through the opened first valve 111, and circulation thereof stops at the closed valve 112, whereby the cavity of antenna structure 110*a* begins to fill. Thereafter, when a supply of the liquid metal to antenna structure 110*a* is complete, the actuator 140 controls a closing the first valve 111. For example, when a pressure is increased to a reference value or more, the actuator 140 may transmit a message notifying this to the controller 170. The controller 170, having received the message determines that a supply of the liquid metal is complete, i.e., that antenna structure 110*a* is adequately filled with liquid metal, and sends a command signal to close the first valve 111. Alternatively, the above process is performed in a counterclockwise fashion, in which the first valve 111 is initially closed, rather than the second valve 112, and so forth.

In this way, when liquid metal adequately fills in the body 115 of the first antenna structure 110*a*, it operates as an antenna. That is, the first antenna structure 110*a* transfers a received wireless signal through a first RF feed connector 113 to the RF unit 160 or transmits a signal from RF unit 160 to radiate the wireless signal to the air. As mentioned above, first antenna structure 110*a* is preferred in the electronic device 10 orientation of the portrait mode.

As shown in FIG. 4B, when the electronic device 10 is in a portrait view mode, the controller 170 recognizes this orientation condition through the sensor unit 180 and controls the actuator 140 to supply a liquid metal to a body 125 of the second antenna structure 110*b*, since the second antenna structure 110*b* is the structure least affected by the presence of the user's hands. This can be done via the controller 170 controlling closing of valve 122 while opening all the other valves, and controlling actuator 140 to circulate a liquid metal clockwise. Alternatively, valve 121 is controlled to close while all other valves are opened, and the actuator 140 circulates the liquid metal counterclockwise. When the body 125 is adequately filled, the valve 121 or 122, as the case may be, is closed, and the second antenna structure 110*b* is in suitable state to act as the sole antenna radiator of electronic device 10 A similar operation can be performed for the third antenna structure 110*c* when it is desired to employ it as the sole antenna under another predetermined condition.

It is noted that a switch unit 190 (illustrated schematically) is positioned between the RF unit 160 and the RF feed connectors 113, 123, 133. The switch unit 190 can be a single pole, multi-throw (SPxT) type switch and includes one input terminal and a plurality of output terminals. The input terminal of switch unit 190 is connected to the RF unit 160, and a plurality of output terminals are respectively connected to RF feed connectors 113, 123, 133. The switch unit 190 is switched to connect the RF unit 160 to one of the RF feed connectors 113, 123, or 133 via control of the controller 170. Specifically, when the liquid metal is supplied to the first antenna structure 110*a*, the switch unit 190 is switched to connect RF unit 160 and RF feed connector 113, and likewise for the RF feed connectors 123, 133 of antenna structures 110*b*, 110*c* when they are activated.

Figure 5:
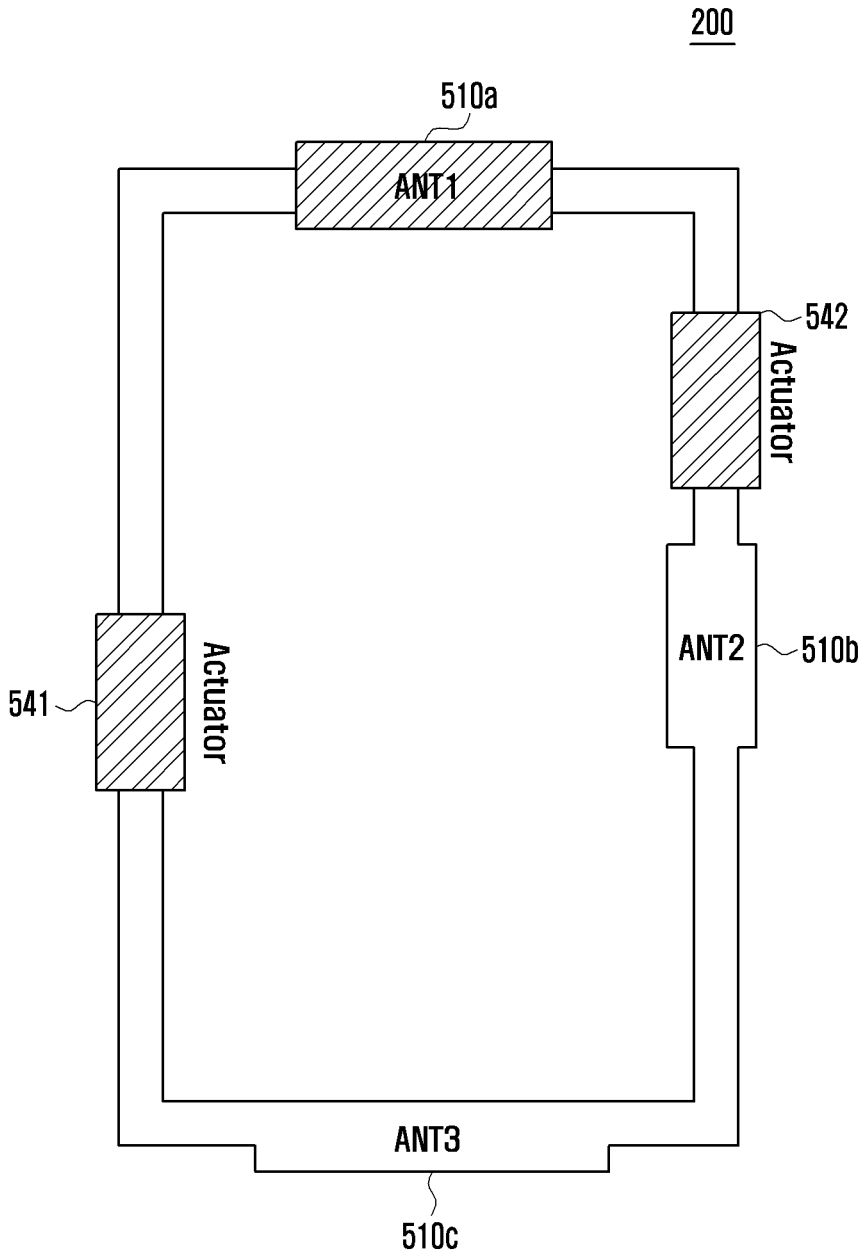
FIG. 5 is a diagram illustrating an antenna using a liquid metal according to a second exemplary embodiment.

FIG. 5 is a diagram illustrating an antenna, 200, using a liquid metal according to a second exemplary embodiment of the present technology. Antenna 200 includes a first antenna structure 510, second antenna structure 520, third antenna structure 530, first actuator 541, and second actuator 542. When comparing FIGS. 1 and 5, the antenna 200 is the same as the antenna 100, except that two actuators are used. That is, in order to more quickly circulate the liquid metal the second exemplary embodiment adds one actuator. In other respects, the second exemplary embodiment 200 is similar to that of the first embodiment 100, thus a redundant discussion thereof is avoided. In still other embodiments, three or more actuators may be employed.

For instance, when antenna structure 510*a* is selected for the operating antenna, the two valves in each of the antenna structures 510*a*, 510*b* and 510*c* are initially opened. In this state, actuator 541 is controlled to circulate liquid metal in a clockwise direction, while actuator 542 circulates the liquid metal in a counterclockwise direction. The liquid metal is thereby forced between the actuators 541 and 542 in the region that includes antenna structure 510*a*. With proper calibration of the forces supplied by actuators 541 and 542, substantially all the liquid metal will be forced within antenna structure 510*a* after a predetermined time. At this point, both valves of antenna structure 510*a* can be controlled to close, whereby requisite operation thereof as an antenna can be realized.

Figure 6:
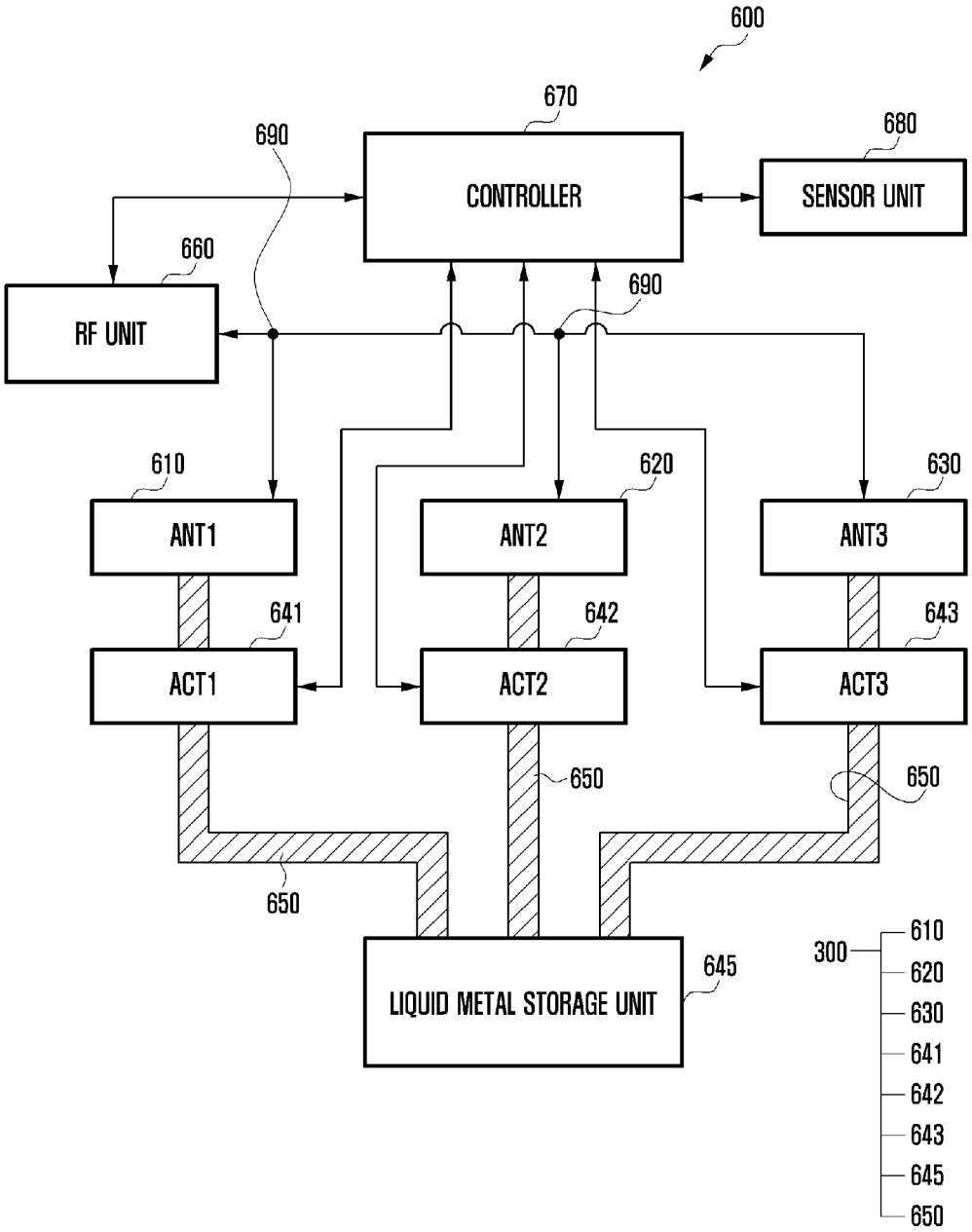
FIG. 6 is a diagram illustrating an electronic device including an antenna using a liquid metal according to a third exemplary embodiment.

FIG. 6 is a diagram illustrating an electronic device including an antenna using liquid metal according to a third exemplary embodiment of the present technology. Electronic device 600 includes an antenna 300 using liquid metal, RF unit 660, controller 670, and sensor unit 680. Antenna 300 includes a first antenna structure 610, second antenna structure 620, third antenna structure 630, first actuator 641, second actuator 642, third actuator 643, liquid metal storage unit 645, and tube 650.

The liquid metal storage unit 645 stores a liquid metal and is selectively connected to the antenna structures through the actuators 641, 642, 643 and tube 650. It is noted, when amounts of a liquid metal required by the first antenna structure 610 to the third antenna structure 630 are about the same, the liquid metal storage unit 645 may be omitted. In this case, the portions of the tube 650 beneath the actuators 641, 642, 643 could be joined. Further, a predetermined amount of liquid metal may be injected into tube 650, or one of the antenna structures may be pre-filled with an amount of liquid metal sufficient to realize a radiator of suitable performance. The remaining constituent elements of the antenna 300 perform a function similar to those in the foregoing exemplary embodiments and thus for convenience of description, a detailed description thereof is omitted.

In antenna 300, the first, second and third antenna structures 610, 620, 630 are connected in parallel rather than in series as in the prior embodiments. The first actuator 641, second actuator 642, and third actuator 643 are connected to the first antenna structure 610, second antenna structure 620, and third antenna structure 630, respectively, through the tube 650. The first actuator 641, second actuator 642, and third actuator 643 are connected to the liquid metal storage unit 645 through the tube 650.

The controller 670 drives one of the first actuator 641 to the third actuator 643 according to a state of the electronic device 600 recognized through the sensor unit 680, controls to supply a liquid metal to an antenna structure connected to the driven actuator, and controls the remaining actuators to move a liquid metal existing at another antenna structure to the liquid metal storage unit 645. For example, in a state in which a liquid metal is supplied to the first antenna structure 610, when movement of a liquid metal to the third antenna structure 630 is requested, the controller 670 controls the third actuator 643 to supply a liquid metal stored at the liquid metal storage unit 645 to the third antenna structure 630 and controls the first actuator 641 to move the liquid metal stored at the first antenna structure 610 to the liquid metal storage unit 645. Two SP2T switches 690 are utilized to switch RF transmit and receive power between RF unit 660 and the selected one of the antenna structures 610, 620 or 630.

Figure 7:
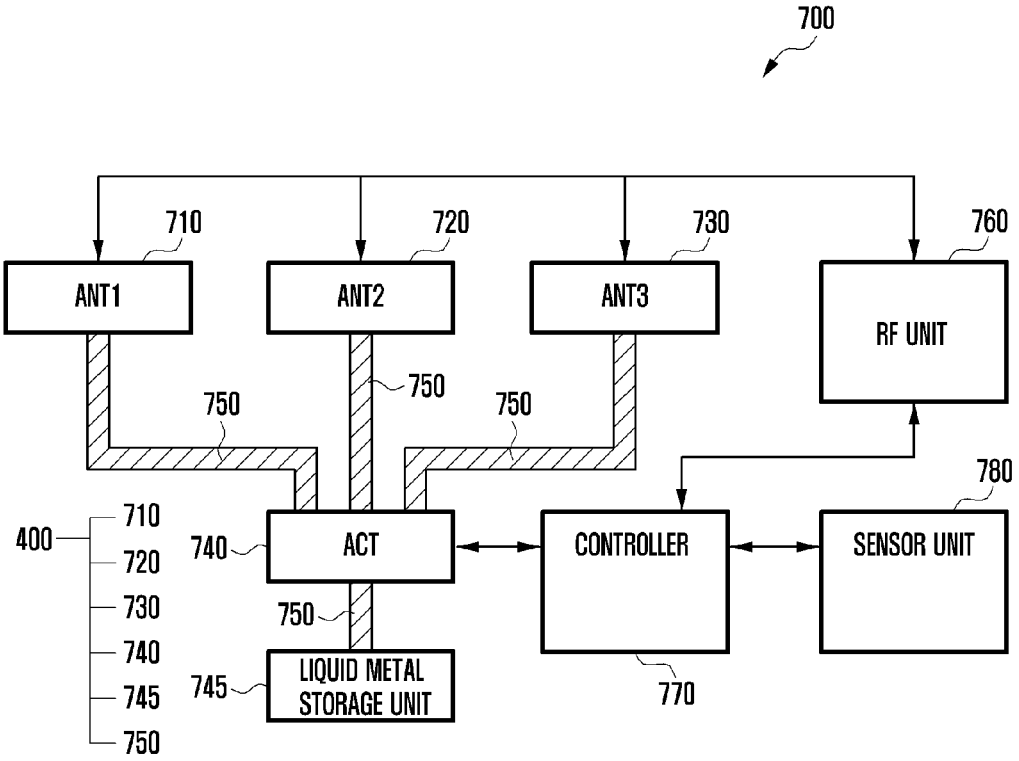
FIG. 7 is a diagram illustrating an electronic device including an antenna using a liquid metal according to a fourth exemplary embodiment.

FIG. 7 is a diagram illustrating an electronic device, 700, including an antenna using liquid metal according to a fourth exemplary embodiment of the present technology. Electronic device 700 includes an antenna 400 using liquid metal, RF unit 760, controller 770, and sensor unit 780. Antenna 400 includes a first antenna structure 710, second antenna structure 720, third antenna structure 730, actuator 740, liquid metal storage unit 745, and tube 750.

Antenna 400 having the above configuration supplies liquid metal to the first antenna structure 710 to the third antenna structure 730 using one actuator 740. Specifically, the controller 770 recognizes a state of the electronic device 700 by analyzing a signal input from the sensor unit 780 and controls the actuator 740 to supply a liquid metal stored at the liquid metal storage unit 745 to one of the first antenna structure 710 to the third antenna structure 730 according to the recognized state of electronic device 700. The fourth exemplary embodiment is similar to the above-described third exemplary embodiment, except that one actuator is used. Therefore, a redundant detailed description thereof is omitted.

Figure 8:
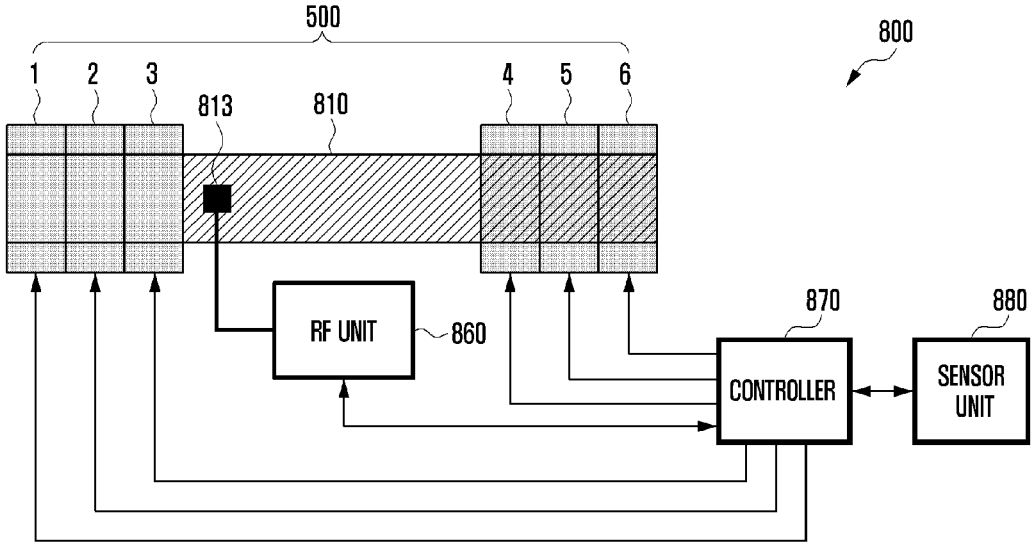
FIG. 8 is a diagram illustrating an electronic device including an antenna using a liquid metal according to a fifth exemplary embodiment.
Figure 9:
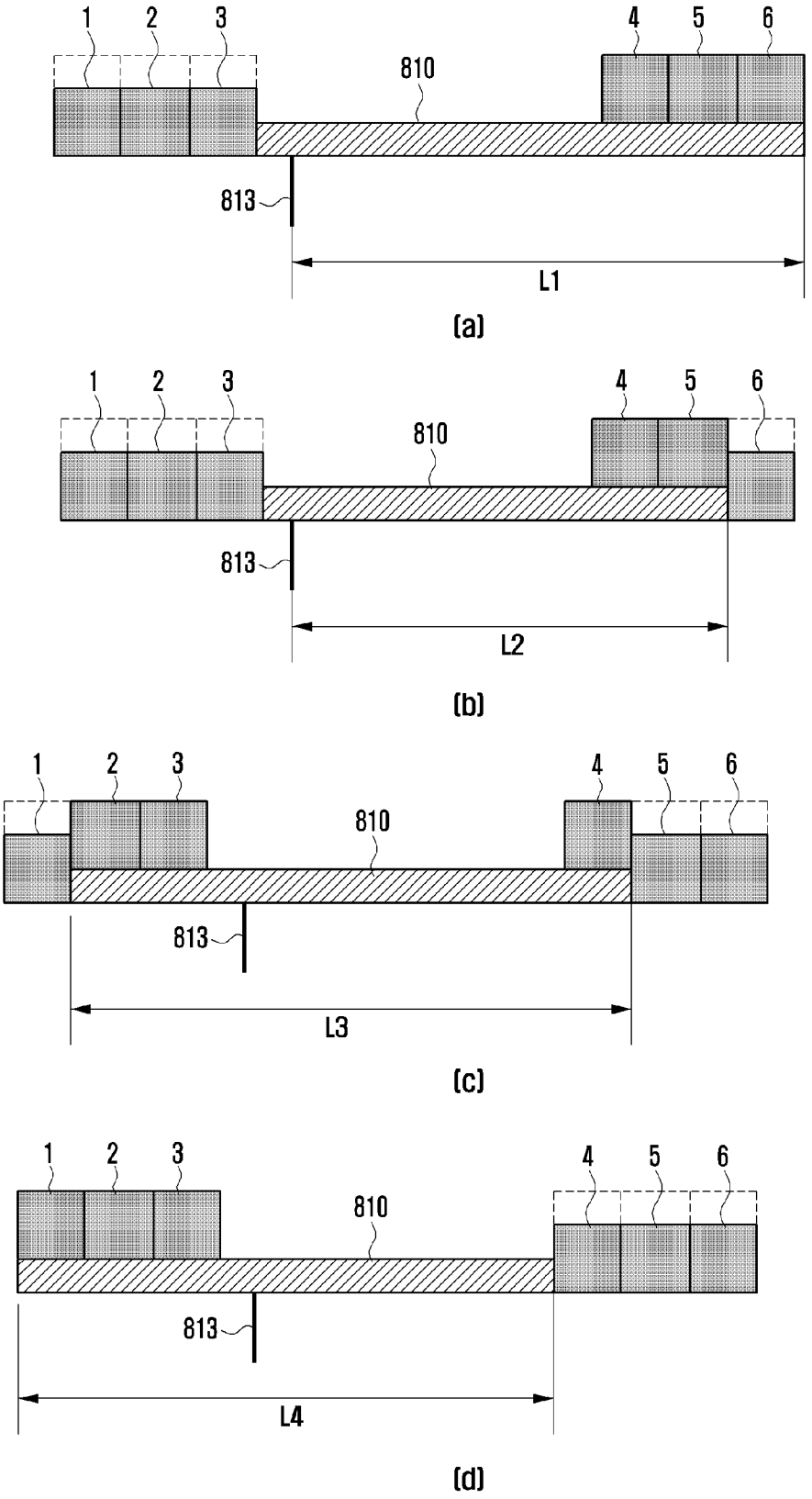
FIG. 9 is a diagram illustrating a method of operating an antenna using a liquid metal according to a fifth exemplary embodiment.

FIG. 8 is a diagram illustrating an electronic device, 800, including an antenna 500 using liquid metal according to a fifth exemplary embodiment of the present technology. FIG. 9 depicts diagrams illustrating a method of operating antenna 500.

Referring to FIGS. 8 and 9, the electronic device 800 includes antenna 500, RF unit 860, controller 870, and sensor unit 880. Unlike the previous described antenna embodiments in which each antenna structure has a fixed radiator pattern, antenna 500 is configured change a form of a radiator pattern thereof. To this end, antenna 500 may include an antenna structure 810 of a tube form including a liquid metal, a plurality of actuators 1, 2, 3, 4, 5, and 6 positioned at end portions of the antenna structure 810, the controller 870 for controlling the plurality of actuators 1-6, RF unit 860, and sensor unit 880.

The plurality of actuators 1-6 are disposed in a sequence in the end portions of the antenna structure 810 to generate, via pressure, a partial operational area of the antenna structure 810 according to a control signal. For example, three of the actuators 1-6 may be disposed at both ends of the antenna structure 810, as shown in FIG. 8. In this case, the antenna structure 810 moves a liquid metal of a pressed portion to another location electrically connected via the liquid metal to the central portion of tube 810 and thus a form thereof is deformed. For this, it is preferable that the antenna structure 810 is made of an elastic material.

The controller 870 recognizes a state of the electronic device 800 through the sensor unit 880 and controls the first actuator 1 to the sixth actuator 6 according to the recognized state of electronic device 800 to change a shape of the antenna structure 810. That is, in the fifth exemplary embodiment of the present technology, a conductor pattern of an antenna is changed to have an optimal radiation performance according to a state of the electronic device 800. For example, as shown in FIG. 9, diagram (a), when the first actuator 1 to the third actuator 3 are in a down (e.g. compressed) state that presses the antenna structure 810 and when the fourth actuator 4 to the sixth actuator 6 are in an up (e.g. decompressed) state, the antenna 500 has a pattern length of "L1", measured from an RF feed connector 813 to a far end.

Further, as shown in diagram (b), when the first actuator 1 to the third actuator 3 and the sixth actuator 6 are in a down state and when the fourth actuator 4 and the fifth actuator 5 are an up state, the antenna 500 has a shorter pattern length of "L2", again measured from the RF feed connector 813 to the far end. (The length from RF feed connector 813 to the near end on the left hand side remains the same.) In this way, apparatus 500 adjusts a length of a radiator pattern using an actuator (in this example, by using multiple actuators).

As shown in diagram (c), when the first actuator 1, the fifth actuator 5, and the sixth actuator 6 are in a down state and when the second actuator 2 to the fourth actuator 4 are in an up state, the antenna 500 has a pattern length of "L3", measured between opposite ends, and as shown in (d), when the first actuator 1 to the third actuator 3 are in an up state and when the fourth actuator 4 to the sixth actuator 6 are in a down state, the antenna 500 has a radiator pattern length of "L4" measured between opposite ends. In this case, when comparing the configurations of (c) and (d), it can be seen that a physical length is about the same, but a position of an RF feed connector 813 relative to the respective near and far ends of the radiator is changed. In this way, the antenna 500 controls an up/down state of the first actuator 1 to the sixth actuator 6 according to a state of the electronic device 800 and thus appropriately changes a length of a radiator pattern and a relative position of the RF feed connector 813. Thereby, the electronic device 800 appropriately controls a length of the radiator pattern and a RF feed position according to a state change of the electronic device 800 and thus maintains an optimal radiation performance.

It is noted here that while six actuators are exemplified in FIGS. 8 and 9, antenna 500 can be alternatively configured with more or fewer than six actuators. A single actuator can be employed in certain applications to achieve a desired variation.

Figure 10:
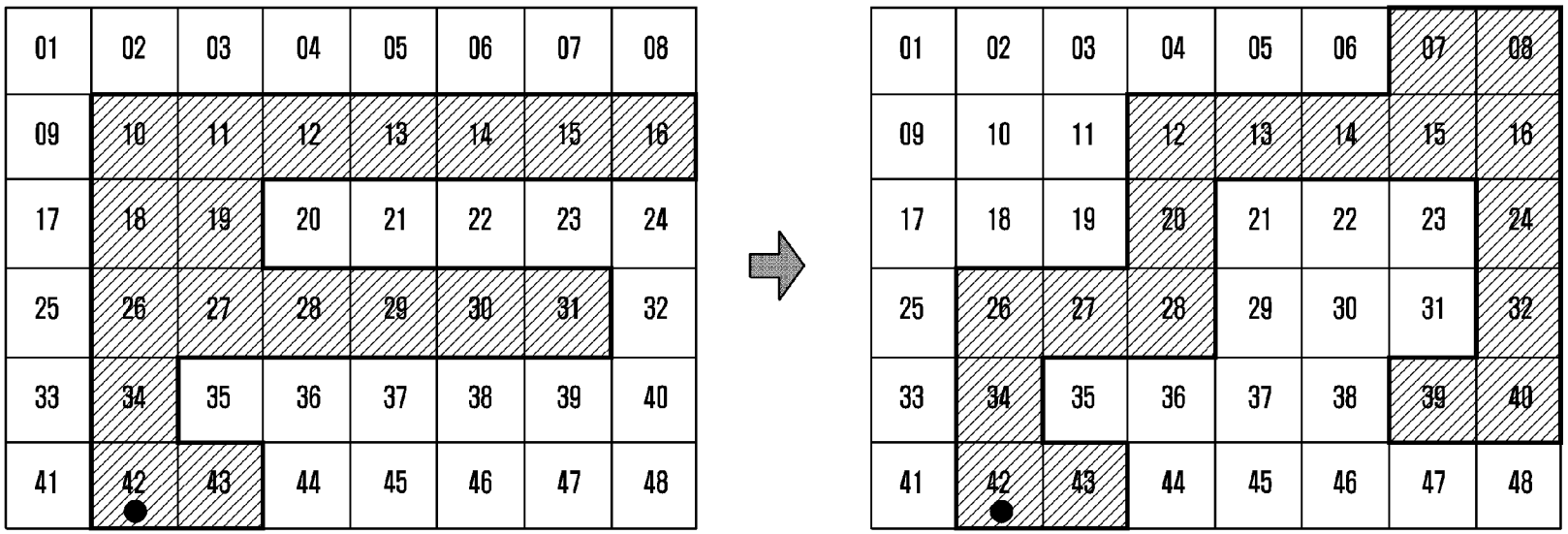
FIG. 10 is a diagram illustrating an antenna using a liquid metal according to a sixth exemplary embodiment.
Figure 11:
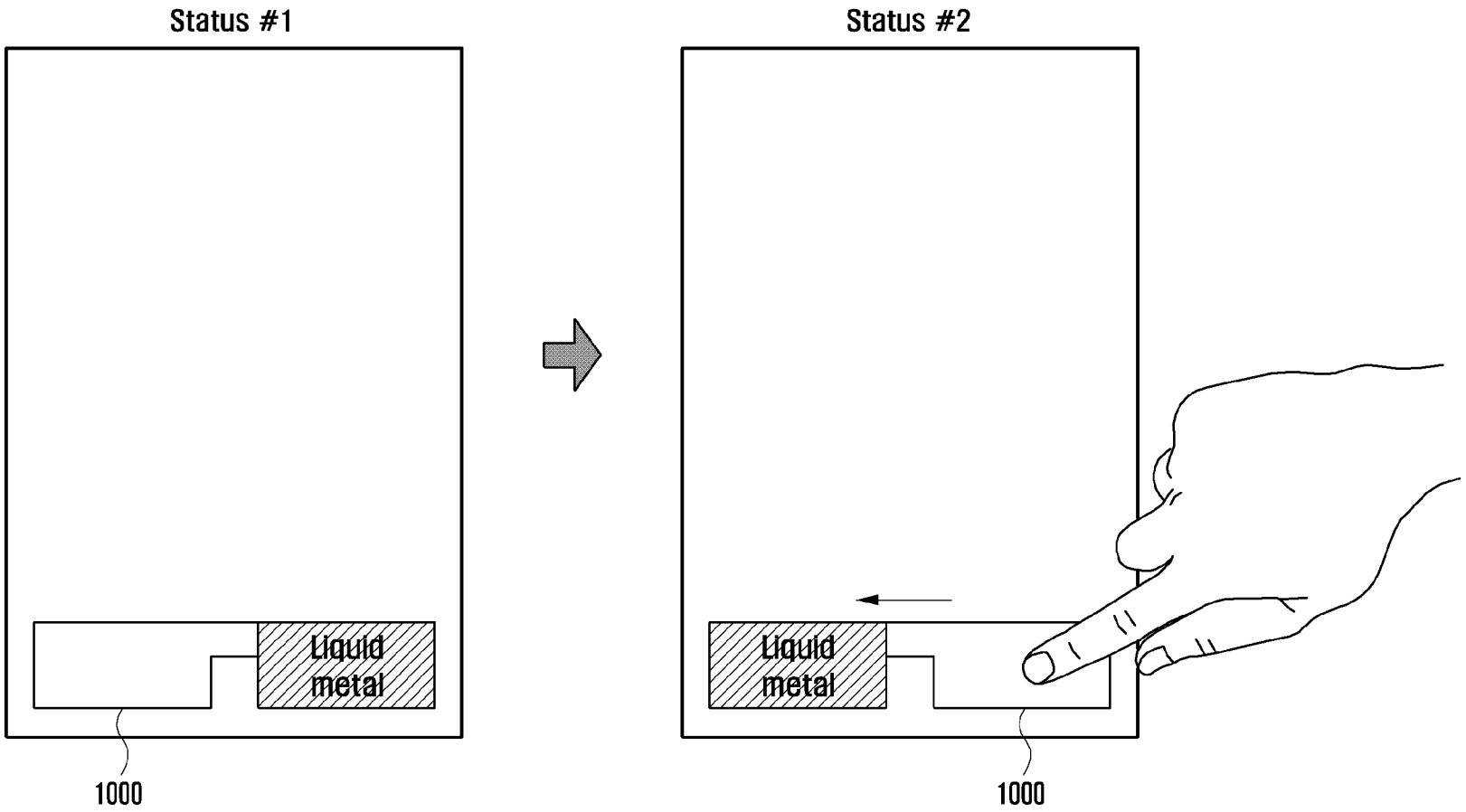
FIG. 11 is a diagram illustrating an operation example of an antenna using a liquid metal according to a sixth exemplary embodiment.

FIG. 10 is a diagram illustrating an antenna, 1000, using a liquid metal according to a sixth exemplary embodiment of the present technology. FIG. 11 is a diagram illustrating an operation example of the antenna 1000.

Referring to FIGS. 10 and 11, in antenna 1000, a plurality of actuators are arranged in two dimensions (multi-row and multi-column layouts) in an end portion of an antenna structure (not shown). The plurality of actuators are mechanically coupled to the antenna structure. That is, antenna 1000 can freely change a form as well as a length of a radiator pattern. For example, as shown in FIG. 10, the antenna 1000 may appropriately change a radiator pattern according to a state of the electronic device by the control of a controller (not shown). For this, the electronic device including antenna 1000 stores a radiator pattern database (DB) in which a specific radiator pattern is mapped to a state of the electronic device. Alternatively, when a state change of the electronic device through a sensor unit (not shown) is recognized, the electronic device including the antenna 1000 controls a plurality of actuators to change a radiator pattern to a random form, changes the radiator pattern to one of a plurality of previously stored radiator patterns, or measures a radiation performance of each changed form and controls a plurality of actuators to maintain a radiator pattern having the best radiation performance. In the antenna 1000, an RF feed connector for connecting the liquid metal and the RF unit is installed at a fixed position (e.g., 42nd position of FIG. 10). Alternatively, RF feed connectors may be installed at a plurality of positions, and the controller (not shown) may control to connect any one of the RF feed connectors and the RF unit according to a situation.

As described above, the antenna 1000 can freely change a form of a radiator pattern. Thereby, antenna 1000 may be applied to a flexible electronic device. In general, a radiation performance of an antenna changes when a flexible electronic device bends (as the bending also bends the antenna). For example, conventionally, when an antenna of a fixed form is used, if the flexible electronic device is folded and unfolded, antenna performance of the electronic device differs between the two positions. That is, the flexible electronic device using a conventional antenna cannot always maintain an optimal radiation performance. However, when antenna 1000 is used, a form of an antenna conductor pattern may be suitably changed according to a bending level of the flexible electronic device and thus an optimal or near optimal radiation performance can be always provided. For example, as shown in FIG. 11, when approach of a human body is sensed at a periphery of the antenna 1000, a liquid metal may be moved from the right side to the left side. FIG. 11 illustrates movement of a position of a liquid metal, which effectively changes a rectangular radiator pattern from a position on the right side of the electronic device to the left. However, in the example illustrated in FIG. 10, when approach of a human body is sensed, a more complex shape of a radiator pattern may be changed from that shown on the left to the right.

Figure 12A:
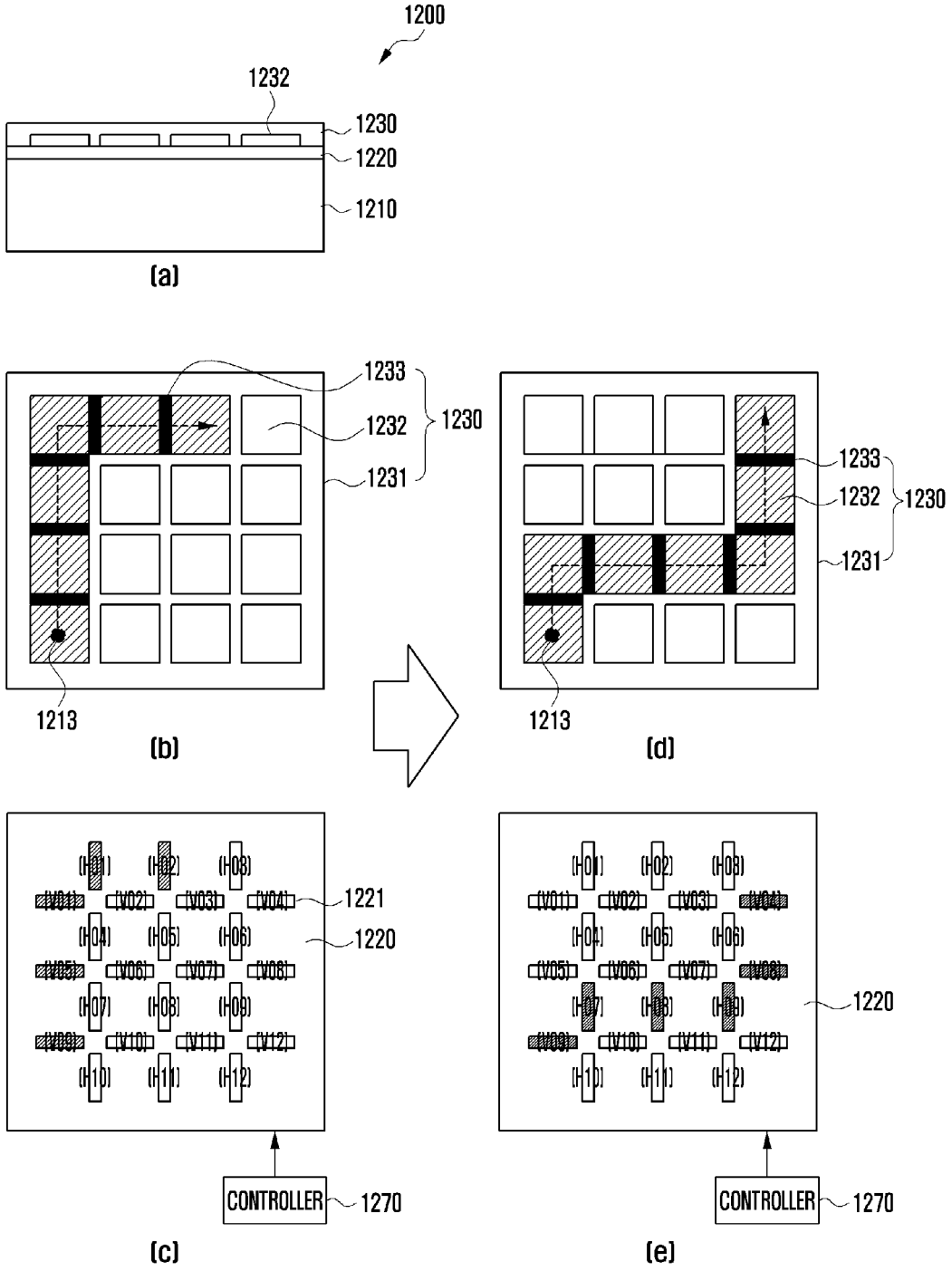
FIG. 12A is a diagram illustrating an antenna using a liquid metal and an operation example thereof according to a seventh exemplary embodiment.
Figure 12B:
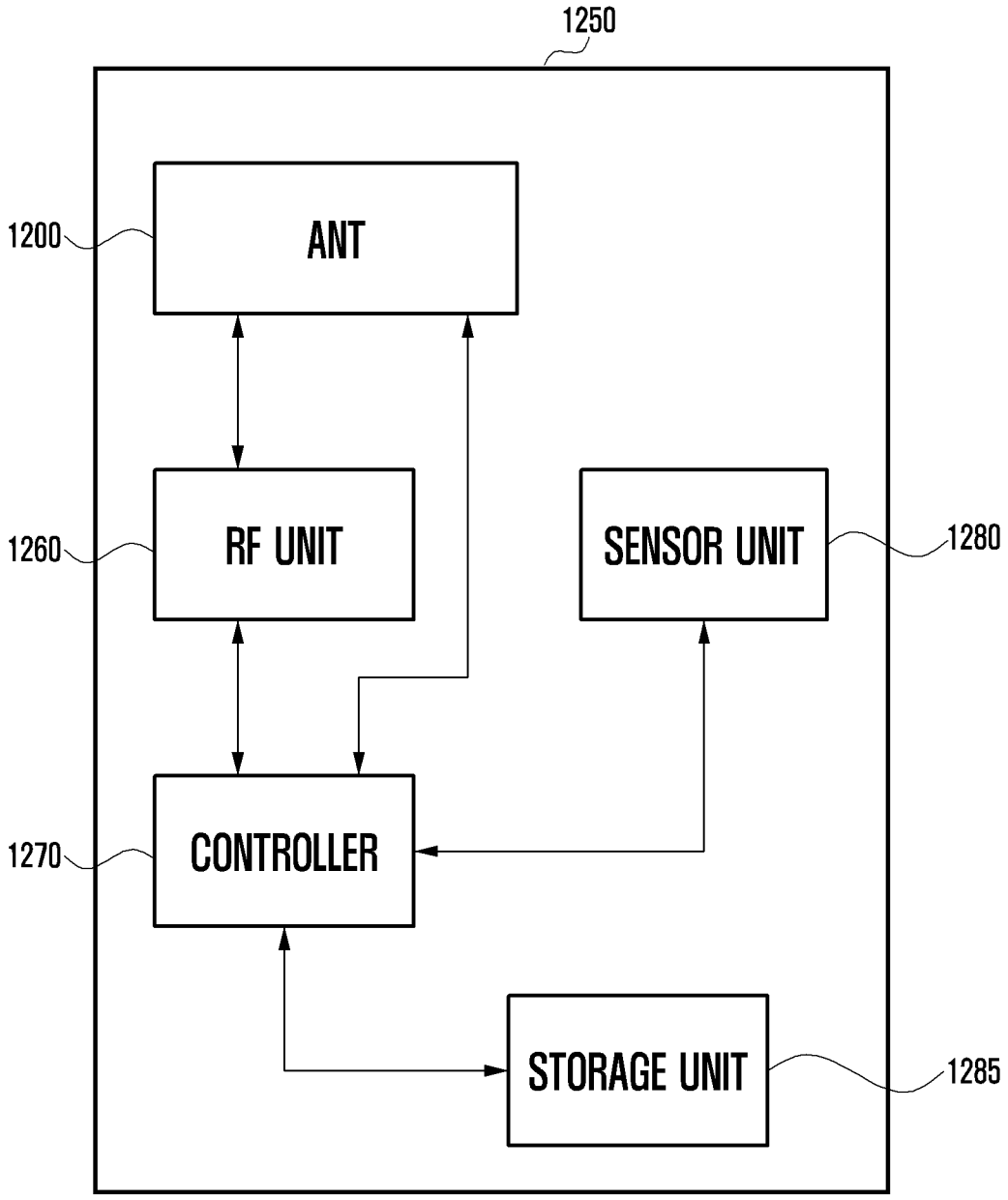
FIG. 12B is a diagram illustrating an electronic device including an antenna using a liquid metal according to a seventh exemplary embodiment.

FIG. 12A is a diagram illustrating an antenna, 1200, using a liquid metal and an operation example thereof according to a seventh exemplary embodiment of the present technology. FIG. 12B is a diagram illustrating an electronic device including an antenna using a liquid metal according to a seven exemplary embodiment.

Referring to FIG. 12A, antenna 1200 includes a carrier 1210, pattern controller 1220, and radiator pattern portion 1230.

The carrier 1210 is a structure that supports the pattern controller 1220 and radiator pattern portion 1230. At an upper surface of the carrier 1210, the pattern controller 1220 and the radiator pattern portion 1230 are mounted. The carrier 1210 is made of a flexible material.

The radiator pattern portion 1230 includes a quadrangular or other suitably shaped tube case 1231, liquid metal 1233, and a plurality of metal pattern elements 1232 positioned at the inside of the tube case 1231, as shown in views (a) and (b). The plurality of metal pattern elements 1232 are disposed in multi-row and multi-column layouts and are separated from each other, as shown in views (b) and (d). The liquid metal 1233 is filled within the tube case 1231.

The pattern controller 1220 connects the metal pattern elements 1232 of the radiator pattern portion 1230 to the liquid metal 1233 and thus controls the liquid metal 1233 of the radiator pattern portion 1230 in order to form a specific radiator pattern. For this, the pattern controller 1220 includes a plurality of electromagnets 1221, as shown in views (c) and (e). The plurality of electromagnets 1221 ("H01", V01", etc.) are disposed in multi-row and multi-column layouts and are positioned in a layer beneath elements 1232 and the liquid metal 1233. Each electromagnet 1221 can be designated to activate/de-activate one particular pattern element 1232, or more than one particular element 1232. Alternatively, two or more electromagnets can be allocated for each element 1232. Each row of electromagnets labeled "Hxx" are oriented in a first direction and arranged in columns, while electromagnets labeled "Vxx" are oriented in an orthogonal direction and can be arranged in a staggered relationship with respect to the "Hxx" elements. In the example of FIG. 12A, a 4×4 array of elements 1232 is suitably controlled via a 3×4 array of electromagnets 1221.

The antenna 1200 controls power supply of the electromagnet 1221 of the pattern controller 1220 to control the radiator pattern portion 1230 to have a specific pattern. For example, as shown in view (c), when power is supplied to electromagnets "H01, H02, V01, V05, and V09" of the pattern controller 1220, the liquid metal 1233 of radiator pattern portion 1230 is moved toward the electromagnets "H01, H02, V01, V05, and V09" to which power is supplied, and the separated metal pattern elements 1232 are electrically connected by the moved liquid metal 1233. Thereby, the radiator pattern portion 1230 has a radiator pattern of a form shown in view (b). When power is supplied as shown in view (e) to electromagnets "H07, H08, H09, V04, V08, and V09" of the pattern controller 1220, radiator pattern portion 1230 has a radiator pattern of a form shown in view (d).

In the foregoing description, antenna 1200 freely changes a radiator pattern shape of the radiator pattern portion 1230 by the control of the pattern controller 1220. For example, when the electronic device is in a landscape view mode, the radiator pattern portion 1230 has a radiator pattern shown in view (b), and when the electronic device is in a portrait view mode, the radiator pattern portion 1230 has a radiator pattern shown in view (d). Further, when the electronic device is a flexible terminal, if the electronic device is folded, a controller 1270 controls the generation of a radiator pattern of view (b), and when the electronic device is unfolded (spread), controller 1270 controls the generation of a radiator pattern of view (d).

Referring to FIG. 12B, an electronic device 1250 including antenna 1200 further includes a sensor unit 1280 for sensing a state of the electronic device, controller 1270 for controlling power supply of the plurality of electromagnets so that the radiator pattern portion has a specific radiator pattern according to the sensed state of the electronic device. Controller 1270 further controls an RF unit 1260 which is RF coupled to antenna 1200 at one or more RF feed connectors 1213. Controller 1270 can read data from a storage unit 1285 which stores a radiator pattern database that maps a state of the electronic device 1250 and a specific radiator pattern. Controller 1270 may also be configured to measure a radiation performance of each of a plurality of preset radiator patterns (e.g., by detecting VSWR and/or bit error rate), when a state change of the electronic device 1250 is sensed and may control the pattern controller 1220 so that the radiator pattern portion 1230 maintains a radiator pattern of the best radiation performance.

In the foregoing description, it has been described that a plurality of metal pattern elements and electromagnets are disposed in multi-row and multi-column layouts. However, other layouts are also available. For example, when the technique of FIG. 12A involving electromagnets is applied to generate a radiator pattern in the shape of a line (similar to that of FIGS. 8 and 9), where the line is adjusted in accordance with the activation of the electromagnets, metal pattern elements and electromagnets may be disposed in a single row or in a single column.

The above-described operations executed by a controller in the above embodiments may be implemented via program instructions read from a recording medium such as a CD ROM, an RAM, a floppy disk, a hard disk, or a magneto-optical disk or computer code downloaded over a network originally stored on a remote recording medium or a non-transitory machine readable medium and to be stored on a local recording medium, so that the methods described herein can be rendered in such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing described herein.

Although exemplary embodiments of the present technology have been described in detail hereinabove, it should be clearly understood that many variations and modifications of the basic inventive concepts herein described, which may appear to those skilled in the art, will still fall within the spirit and scope of the claimed subject matter as defined in the appended claims.

What is claimed is:

1. An antenna using a liquid metal, comprising: an antenna structure comprising an elastic tube containing the liquid metal at an inner space; and at least one actuator positioned in mechanical relation to the antenna structure to change at least one of a position or dimension of a radiator formed by the liquid metal by pressing a partial area of the antenna structure according to a control signal, the pressing deforming the partial area and causing at least some of the liquid metal to move out of the partial area to another location of the antenna structure and thereby cause the change in at least one of a position or dimension of the radiator, wherein if the partial area is not pressed, at least some of the liquid metal is disposed therein and forms at least a part of the radiator, and wherein the at least one actuator comprises a plurality of actuators disposed in a sequence at one or more ends of the antenna structure.

2. The antenna of claim 1, wherein the at least one actuator comprises a plurality of actuators disposed in a sequence at at least one end of the antenna structure.

3. The antenna of claim 1, wherein the at least one actuator comprises a plurality of actuators, and the plurality of actuators are disposed in multi-row and multi-column layouts corresponding to a plurality of portions of the antenna structure.

4. The antenna of claim 1, wherein the antenna structure further comprises a radio frequency (RF) feed connector to connect the liquid metal and an RF unit.

5. An electronic device including the antenna of claim 1, the electronic device further comprising:

a sensor unit sensing a state of the electronic device; and a controller controlling the at least one actuator so that the antenna structure has a preset radiator pattern according to the sensed state of the electronic device.

6. The electronic device of claim 5, wherein the at least one actuator comprises a plurality of actuators, and the plurality of actuators are disposed in multi-row and multi-column layouts in an end portion of the antenna structure.

7. The electronic device of claim 6, wherein the controller measures a performance parameter of each of a plurality of preset radiator patterns, when a state change of the electronic device is sensed and controls the plurality of actuators so that the antenna structure maintains a radiator pattern of an optimum radiation performance.

8. The electronic device of claim 7, further comprising a storage unit for storing a radiator pattern database that maps states of the electronic device to the preset radiator patterns.

9. An antenna using a liquid metal, comprising:

an antenna structure comprising an elastic tube containing the liquid metal at an inner space, the antenna structure including a partial area that, prior to being pressed, contains at least some of the liquid metal and forms at least part of a radiator; and at least one actuator positioned in mechanical relation to the partial area of the antenna structure and operable, according to a control signal, to deform the partial area by pressing sufficiently to cause liquid metal contained in the partial area to move to another location of the antenna structure, so that the partial area no longer forms at least part of the radiator, thereby changing at least one of a position or a dimension of the radiator.

* * * * *